US007156102B2

(12) United States Patent
Ramet

(10) Patent No.: US 7,156,102 B2
(45) Date of Patent: Jan. 2, 2007

(54) COMB INTENDED TO FACILITATE APPLICATION OF A COSMETIC PRODUCT TO LOCKS OF HAIR

(75) Inventor: Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 121 days.

(21) Appl. No.: 10/875,192

(22) Filed: Jun. 25, 2004

(65) Prior Publication Data

US 2005/0022835 A1 Feb. 3, 2005

Related U.S. Application Data

(60) Provisional application No. 60/488,403, filed on Jul. 21, 2003.

(30) Foreign Application Priority Data

Jun. 30, 2003 (FR) ..... 03 07922

(51) Int. Cl.
*A45D 24/00* (2006.01)

(52) U.S. Cl. ..... 132/160; 132/270

(58) Field of Classification Search ..... 132/160, 132/161, 208, 270; D28/21, 28, 29–32
See application file for complete search history.

(56) References Cited

U.S. PATENT DOCUMENTS 1,533,684 A * 4/1925 Abeel ..... 132/144
2,598,330 A * 5/1952 Wilson ..... 132/117
2,915,071 A * 12/1959 Watkins ..... 132/213.1
4,996,996 A * 3/1991 Hirsh ..... 132/160
5,018,542 A 5/1991 Lee
5,152,306 A 10/1992 Stephan
5,231,999 A * 8/1993 Schroettner ..... 132/137
5,694,953 A 12/1997 Stephan et al.
D435,692 S * 12/2000 Anselmo ..... D28/21
6,523,547 B1 2/2003 Crocilla

FOREIGN PATENT DOCUMENTS

FR 1253367 * 12/1959
FR 637955 * 1/1964

* cited by examiner

*Primary Examiner*—Cris L. Rodriguez
*Assistant Examiner*—Rachel A. Running
(74) *Attorney, Agent, or Firm*—Oblon, Spivak, McClelland, Maier & Neustadt, P.C.

(57) ABSTRACT

A comb for the hair including a body having a lengthwise axis (X). At least one first gap is defined between two teeth of a first pair of teeth, with this first gap having a first height. At least one second gap is defined between two teeth of a second pair of teeth, with this second gap having a second height lower than the first height. In a preferred form of the teeth defining the first and second gaps, only the teeth defining the second gap are arranged to hold a lock of hair between them. At least one of the teeth defining the second gap includes a projection extending into this second gap. In a preferred form, all of the teeth defining the first and second gaps are located on the same side of the body of the comb.

66 Claims, 2 Drawing Sheets

COMB INTENDED TO FACILITATE APPLICATION OF A COSMETIC PRODUCT TO LOCKS OF HAIR

CROSS-REFERENCE TO RELATED APPLICATIONS

This document claims priority to French Application Number 03 07922, filed Jun. 30, 2003 and U.S. Provisional Application No. 60/488,403, filed Jul. 21, 2003, the entire contents of which are hereby incorporated by reference.

BACKGROUND OF THE INVENTION

1. Field of the Invention

The present invention relates to a comb intended to facilitate the creation of hairstyles, for example, hairstyles including colored or highlighted locks of hair.

2. Discussion of Background

U.S. Pat. Nos. 5,152,306 and 5,694,953 describe combs having teeth in the form of a hook, intended to grasp locks of hair in order to isolate them from the rest of the hair to facilitate treatment.

U.S. Pat. No. 5,018,542 describes a comb having teeth with some of the teeth equipped with hooks enabling locks of hair to be isolated. The gaps between adjacent teeth are all of the same size or height.

U.S. Pat. No. 6,523,547 describes a known comb incorporating teeth equipped respectively with complex hooks extending into the gaps defined between adjacent teeth so as to isolate locks of hair between the bottom of the gaps and the hooks.

With such combs, the amount of hair taken up by the hook-shaped teeth depends on the depth to which the comb is pressed into the hair, and the quantity of hair comprising each lock drawn out is liable to vary widely from one occasion to another. As a result, it can be difficult for certain hairstyles to be created by an inexperienced person.

There is also a need to be able to color or highlight locks of hair in a reproducible manner over the entire head of hair.

The present invention particularly aims to facilitate the formation of locks of hair of equal size and to improve the reproducibility of hairdressing treatments.

SUMMARY OF THE INVENTION

According to one of its aspects, the invention provides a comb for hair which includes:

- a body having a lengthwise axis,
- at least one first gap defined between two teeth of a first pair of teeth, particularly two adjacent teeth, with this first gap having a first height,
- at least one second gap defined between two teeth of a second pair of teeth, particularly two adjacent teeth, with this second gap having a second height lower than the first height, with the teeth defining the first and second gaps being located on the same side of the body of the comb;
- of the teeth defining the first and second gaps, only the teeth defining the second gap are arranged to hold a lock of hair, with at least one of the teeth defining the second gap incorporating a projection extending into this second gap.

The teeth of the first and second gaps extend so that their respective free ends are not oriented opposite to each other, but are oriented substantially in the same direction relative to the lengthwise axis of the body. By way of example, the free ends of the teeth can be situated substantially on an outwardly concave line, with this line preferably having a curvature substantially matching that of the skull.

According to one aspect, the height of a gap is measured in a direction perpendicular to the lengthwise axis of the body between the bottom of the gap and a free end of at least one of the teeth defining this gap. When the teeth defining a gap are not of the same length relative to the lengthwise axis, the height of this gap is then measured as the distance between the base and the free end of the highest tooth relative to the lengthwise axis.

The number of second pairs of teeth is between 2 and 20, for example.

The quantity of hair capable of being held in the second gap and being lifted by the comb can be limited by the height of this second gap which is lower than the height of the first gap. When making the comb, the height of the second gap can be specified in relation to the size of the locks of hair to be isolated.

The second gap can be filled with a maximum quantity of hair in a reproducible manner each time the comb is used. Locks of treated hair of the same size can thus be formed more easily.

According to an illustrated example, at least one of the teeth defining the second gap can be hook shaped. For example, the aforementioned projection can include an edge extending both towards the bottom of the second gap and towards the other tooth defining this second gap.

In a particular embodiment of the invention, the separation between the teeth defining the second gap is smaller than that between the teeth defining the first gap, with this separation being measured at the free end of the teeth.

The height of the second gap can be, for example, between ¼ and ¾ of the height of the first gap, between ½ and ¾, for example approximately ⅔ of the height of the first gap.

The comb can be made as a single piece by molding at least one plastic material.

At least one of the teeth defining the second gap can be made at least partially of a resiliently deformable material, for example, a thermoplastic material such as a polyolefin.

According to another feature, each of the teeth defining the second gap can include a projection extending in the direction of the opposite tooth.

According to another aspect, a hair treatment process, e.g., for coloring or highlighting at least one lock of hair, is provided. This process includes the following steps:

- isolating at least one lock of hair using a comb such as that discussed above, and
- applying at least one hair treatment, for example a highlighting or coloring product, to the lock of hair.

A further object of the invention is to provide a hair treatment process for several locks of hair. This process includes the following steps:

- simultaneously isolating several locks of hair using a comb such as that discussed above,
- applying a hair treatment, e.g., a highlighting or coloring product, to the locks of hair.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
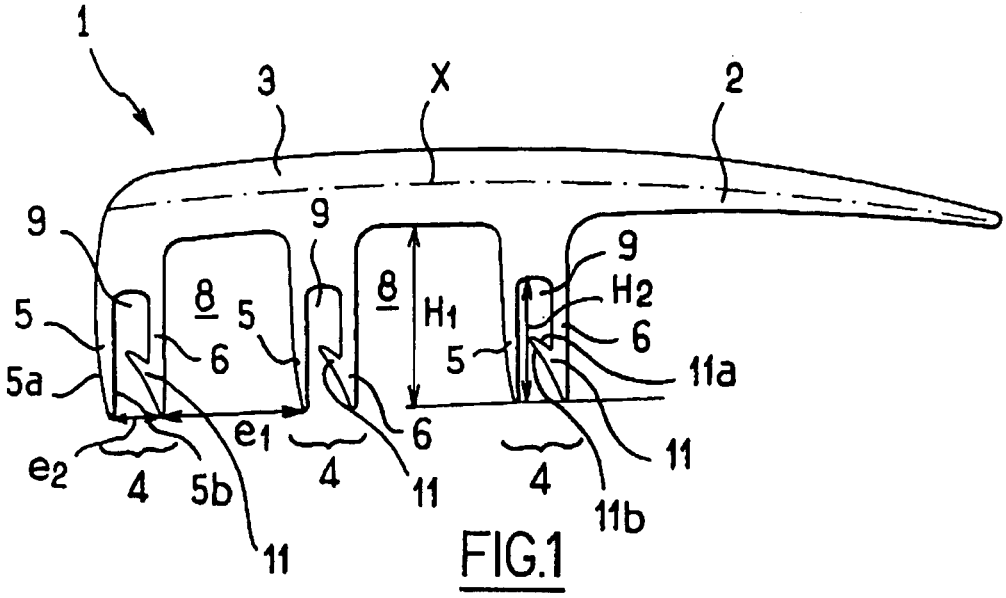
FIG. 1 is a side view of an example of a comb according to the invention.

The comb 1 shown in FIG. 1 has a generally flat and elongated shape on a lengthwise axis X, with a handle 2 and a body 3 incorporating a series of groups of teeth 4 each including, in the illustrated example, a pair of teeth 5 and 6 extending generally in a direction perpendicular to the axis X.

In the example illustrated, two adjacent teeth 5 and 6, i.e. consecutive teeth respectively belonging to two adjacent groups 4, define a first gap 8 of which the height $H_1$ is greater than the height $H_2$ of the gap 9 defined by teeth 5 and 6 in the same group 4. As should be apparent, one tooth of the first pair of teeth forming the first gap can also be a tooth of the second pair of teeth forming the second gap. However, the pairs could also be completely separate pairs without having a common tooth. The heights $H_1$ and $H_2$ are measured in a direction perpendicular to the axis X between the bottom of the gaps 8 or 9 and the free ends of the teeth, as can be seen particularly in FIG. 1. As can also be seen in FIG. 1, in the illustrated example, the distance or spacing from the lengthwise axis of the comb to the base of the second gap is larger than the distance from the lengthwise axis to the base of the first gap.

The spacing $e_2$ between the teeth defining the second gap 9 is less than that $e_1$ between the teeth defining the first gap 8. As can also be seen in FIG. 1, the spacing (in the lengthwise direction of the comb) between two of the second gaps 9 is also larger than the width of the second gap 9.

In the example considered, the teeth 5 in each group 4 each can have a substantially rectilinear lengthwise axis. When viewed in a direction perpendicular to axis X and to their lengthwise axis, these teeth 5 can present opposite sides 5*a* and 5*b* substantially parallel or slightly convergent towards the free end of the corresponding teeth.

In the example of FIG. 1, the teeth 6 are hook shaped with a projection 11 at the end extending into the gap 9. This projection 11 has an inner edge 11*a* extending towards tooth 5 and towards axis X. The projection 11 also has an outer edge 11*b* sloping towards tooth 5, facilitating the insertion of hair between teeth 5 and 6. The inner edge 11*a* enables a lock of hair to be held between the teeth 5 and 6.

In the example illustrated, the entire comb 1 is preferably made in one piece by molding at least one plastic material. However, in accordance with the invention, the comb can be made of one or more other materials, for example a metal, and the comb can be formed of plural pieces. Preferably, to minimize the weight of the comb, the handle 2 and/or the body 3 can include through-holes. Although the free ends of the teeth extend to a substantially straight line in the illustrated embodiment, the free ends can extend generally to a concave line of curvature, e.g., matching a curvature of the skull, as noted earlier.

By way of example, the comb can be made entirely of a resiliently deformable material, for example polypropylene or polyethylene plus additives, to enable a lock of hair to move past the projection 11 more easily by elastic deformation of at least one of the teeth 5 and 6.

The comb 1 can also be made from several materials, for example by bi-injection of two or more materials. For example, the projections 11 can be made of a resiliently deformable material, while the rest of the comb can be made of a more rigid material.

As a variant, the teeth 5 and 6 can each be made entirely in a resiliently deformable material and the remainder of the comb of a more rigid material. As should be apparent, various combinations are possible in accordance with the present invention.

As a further variant, only one of the teeth 5 or 6 can be made in a resiliently deformable material and the remainder of the comb 1 in a more rigid material. As should be apparent, various combinations are possible in accordance with the present invention.

Figure 2:
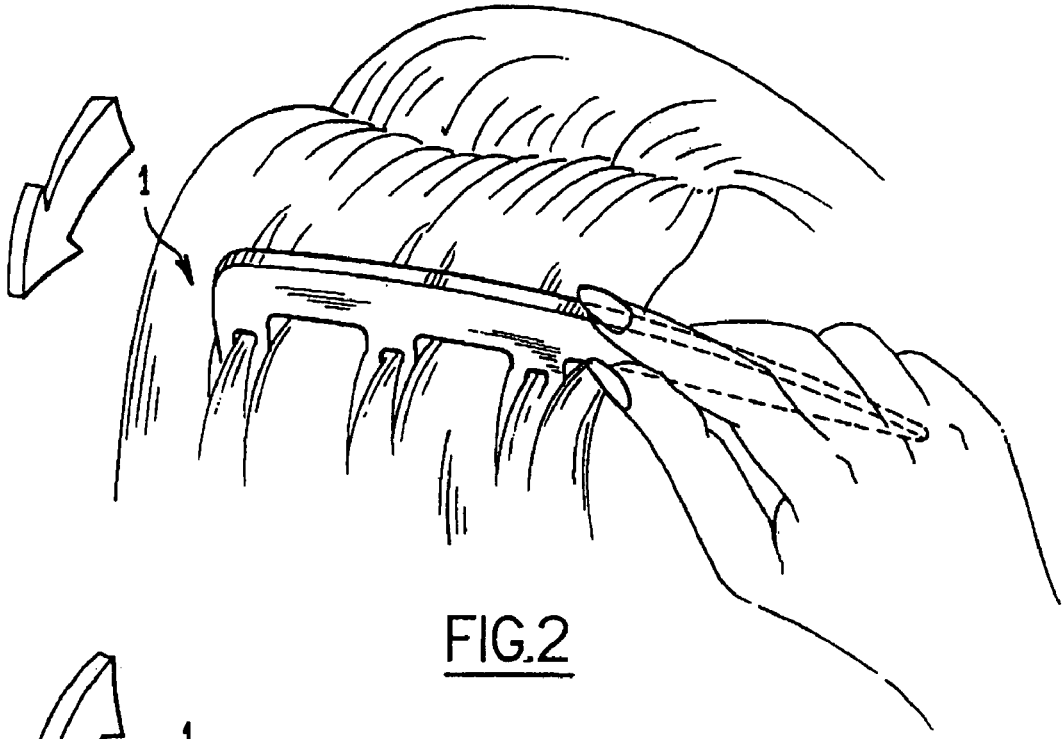
FIGS. 2 and 3 illustrate the use of the comb in FIG. 1.
Figure 3:
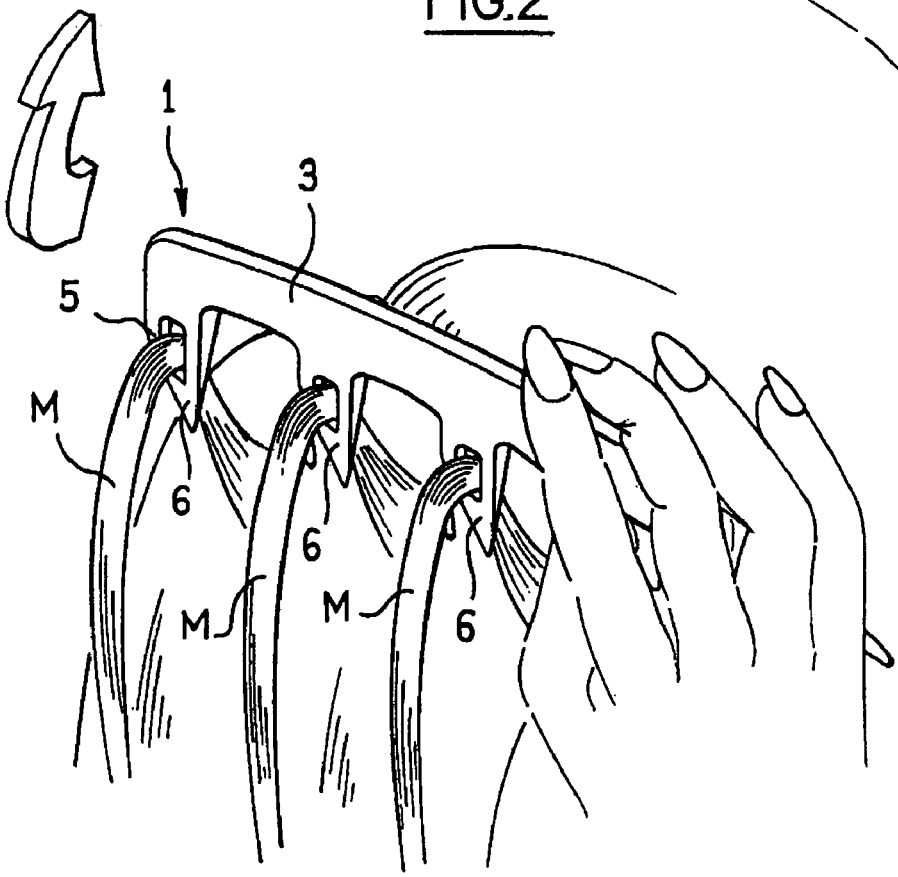

An example of use of the comb 1 will now be described in reference to FIGS. 2 and 3. The comb can be inserted into the hair and drawn through the hair as illustrated in FIG. 2, thereby enabling the hair to enter the second gaps 9. The comb 1 can then be raised as illustrated in FIG. 3, so as to isolate locks M of hair, which can then be grasped by the user and treated with a product. The invention can be particularly advantageous in applying a product intended to impart a lightening or coloring effect. The remainder of the hair that is not being held drops out of the way by gravity.

The user can use the comb by locating a given gap 9, for example that situated at the distal end of the comb, at a reference position on the head before commencing the treatment.

As required, at each subsequent use of the comb, the user can work with reference to a lock of hair already treated. This makes it possible for example to treat either the left or right side in the same manner as the other side.

Figure 4:
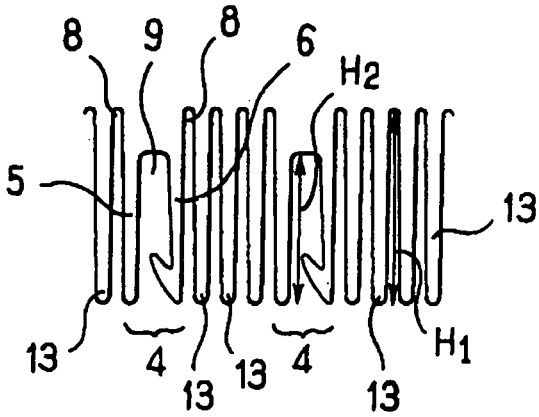
FIG. 4 is a partial diagrammatic view of an alternative embodiment of the comb.

Clearly, various modifications can be made to the invention without exceeding its scope. For example, as shown in FIG. 4, the comb 1 can include other teeth 13 between the groups of teeth 4, with the height $H_1$ of the gap 8 formed between one of the teeth 5 or 6 of a group of teeth 4 and an adjacent tooth 13 being greater than the height $H_2$ of the gap 9 formed between teeth 5 and 6, as in the previous embodiment.

Figure 5:
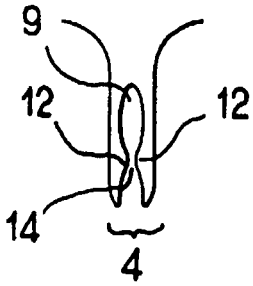
FIG. 5 is a view similar to FIG. 4 of another alternative embodiment.

As illustrated in FIG. 5, each group of teeth 4 can also include at least one projection 12 on each tooth. By way of example, in the illustrated arrangement, a boss of each tooth extends toward the opposite tooth, with the bosses defining between them a narrow passage 14 serving to hold a lock of hair. This holding action can be facilitated as appropriate by the choice of materials constituting the comb or by means of a coating applied to the surface of the teeth.

The teeth can be disposed with a substantially constant spacing between them. However, in accordance with the invention, the spacing between the teeth can also vary for different positions along the lengthwise axis X.

Throughout the description, including the claims, expressions like including one, having, or comprising should be understood to be synonymous with "including at least one", unless otherwise specified.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A comb for hair comprising:

a body having a lengthwise axis;

at least one first gap defined between two teeth of a first pair of teeth, wherein the first gap has a first height;

at least one second gap defined between two teeth of a second pair of teeth;

wherein a height from the lengthwise axis to the free end of each tooth of the first and second pairs of teeth is substantially the same, and wherein a distance from the lengthwise axis to a bottom of the first gap is smaller than a distance from the lengthwise axis to a bottom of the second gap such that the second gap has a second height smaller than the first height;

wherein, of the teeth defining the first and second gaps, only the teeth defining the second gap are arranged to hold a lock of hair, and wherein at least one tooth defining the second gap includes a projection extending at least partially along a direction of said lengthwise axis such that said projection extends into the second gap;

wherein all of the teeth defining the first and second gaps are located on the same side of the body of the comb; and wherein a plurality of first and second pairs of teeth defining a plurality of first and second gaps are provided along a lengthwise direction of the comb, and wherein at least one first gap is provided between two of said second gaps.

2. A comb according to claim 1, wherein the teeth defining each first gap are adjacent teeth.

3. A comb according to claim 2, wherein the teeth defining each second gap are adjacent teeth.

4. A comb according to claim 3, wherein each of the teeth defining at least one of the second gaps includes a projection extending towards the opposite tooth.

5. A comb according to claim 3, wherein at least one of the teeth defining at least one of the second gaps is hook shaped.

6. A comb according to claim 5, wherein the at least one of the teeth which is hook shaped is made at least partially of a resiliently deformable material.

7. A comb according to claim 5, wherein the at least one of the teeth defining at least one of the second gaps includes an edge extending both towards a bottom of the second gap and towards the other tooth defining this second gap.

8. A comb according to claim 5, wherein a spacing between the teeth defining each second gap is smaller than that between the teeth defining each first gap.

9. A comb according to claim 8, wherein the second height of each second gap is between ¼ and ¾ of the first height of each first gap.

10. A comb according to claim 9, wherein the second height is between ½ and ¾ of the first height.

11. A comb according to claim 10, wherein the second height is approximately ⅔ of the first height.

12. A comb according to claim 9, wherein the comb includes from 2 to 20 second pairs of teeth.

13. A comb according to claim 1, wherein the comb is molded as a one piece molding with at least one plastic material.

14. A comb according to claim 1, wherein at least one of the teeth defining the second gap is made at least partially of a resiliently deformable material.

15. A comb according to claim 1, wherein the projection extends both towards a bottom of the second gap and towards the other tooth defining this second gap.

16. A comb according to claim 1, wherein the second height of each second gap is between ¼ and ¾ of the first height of each first gap.

17. A comb according to claim 1, wherein the second height of each second gap is between ½ and ¾ of the first height of each first gap.

18. A comb according to claim 1, wherein at least one of the teeth defining each of the second gaps is hook shaped.

19. A comb according to claim 1, wherein one of the first gaps is adjacent to one of the second gaps, and wherein a tooth of the first pair defining said one of the first gaps is also a tooth of the second pair defining said one of the second gaps.

20. A comb according to claim 1, wherein each first gap is adjacent to at least one of the second gaps, and wherein a tooth of each first pair is also a tooth of one of the second pairs.

21. A comb according to claim 1, wherein a plurality of teeth are provided between two second pairs of teeth.

22. A comb according to claim 1, wherein the plurality of first gaps are alternatingly disposed with the plurality of second gaps along a lengthwise direction of the comb.

23. A comb according to claim 22, wherein a width of at least some of the first gaps in the lengthwise direction of the comb is larger than a width of at least some of the second gaps.

24. A comb according to claim 22, wherein the projection of the at least one tooth of each second pair of teeth extends both towards a bottom of the second gap and towards the other tooth defining the second gap.

25. A comb according to claim 1, further including a handle to grasp the comb at a location spaced from the first and second pairs of teeth in a lengthwise direction of the comb.

26. A comb according to claim 1, wherein a distance from one second gap to a next second gap along a lengthwise direction of the comb is larger than a width of at least one of said second gaps in said lengthwise direction.

27. A comb according to claim 1, wherein said at least one tooth defining each second gap includes a portion extending transverse to said lengthwise axis, and wherein said projection extends from said portion, and wherein each respective second gap includes a first width extending from said portion to another tooth of said second pair, and further wherein a second width extends from said portion to a next adjacent tooth on a side of said portion opposite said another tooth, and wherein a size of said first width is different from a size of said second width, and wherein said at least one tooth having said projection is positioned between said another tooth and said next adjacent tooth.

28. A comb according to claim 27, wherein said first width is larger than said second width.

29. A comb according to claim 28, wherein a plurality of first gaps are between one of said second gaps and a next adjacent one of said second gaps.

30. A comb according to claim 27, wherein said second width is larger than said first width.

31. A comb according to claim 30, wherein said first width is a width of said second gap and said second width is a width of said first gap, and wherein a plurality of said first and second gaps are alternatingly disposed along the lengthwise axis.

32. A process for coloring or highlighting at least one lock of hair, including the following steps:

providing a comb which includes a body having a lengthwise axis, the comb including at least one first gap defined between two teeth of a first pair of teeth, wherein the first gap has a first height, the comb further including at least one second gap defined between two teeth of a second pair of teeth, wherein a height from the lengthwise axis to the free end of each tooth of the first and second pairs of teeth is substantially the same, and wherein a distance from the lengthwise axis to a bottom of the first gap is smaller than a distance from the lengthwise axis to a bottom of the second gap such that the second gap has a second height smaller than the first height, wherein, of the teeth defining the first and second gaps, only the teeth defining the second gap are arranged to hold a lock of hair, and wherein at least one tooth defining the second gap includes a projection extending at least partially along a direction of said lengthwise axis such that said projection extends into the second gap, and wherein all of the teeth defining the first and second gaps are located on the same side of the body of the comb, and wherein a plurality of first and second pairs of teeth defining a plurality of first and second gaps are provided along a lengthwise direction of the comb, and wherein at least one first gap is provided between two of said second gaps;

isolating at least one lock of hair using at least one of the second gaps of the comb while hair passing through at least one of the first gaps is released such that it is not isolated; and applying a hair treatment product to the at least one lock of hair.

33. A process according to claim 32, wherein the process includes isolating several locks of hair simultaneously using the second gaps of the comb.

34. A process according to claim 32, wherein the hair treatment product is a highlighting product.

35. A process according to claim 32, wherein the hair treatment product is a hair coloring product.

36. A process according to claim 32, wherein the projection of the at least one tooth of each second pair of teeth extends both towards a bottom of the second gap and towards the other tooth defining this second gap.

37. A process according to claim 32, wherein the plurality of first gaps is alternatingly arranged with the plurality of second gaps along a lengthwise direction of the comb.

38. A comb for hair comprising:

a body having a lengthwise axis;

at least one first gap defined between two teeth of a first pair of teeth, wherein the first gap has a first height;

at least one second gap defined between two teeth of a second pair of teeth, wherein the second gap has a second height smaller than the first height;

wherein the first and second pairs of teeth are located on the same side of the body of the comb;

wherein the teeth defining the second gap are arranged to hold a lock of hair, and wherein at least one tooth defining the second gap includes a projection extending into the second gap;

wherein said at least one tooth defining said second gap includes a portion extending transverse to said lengthwise axis, and wherein said projection extends from said portion, and wherein said projection at least partially extends in a direction along said lengthwise axis to extend into said second gap;

wherein said second gap includes a first width extending from said portion to another tooth of said second pair, and further wherein a second width extends from said portion to a next adjacent tooth on a side of said portion opposite said another tooth, and wherein a size of said first width is different from a size of said second width, and wherein said at least one tooth having said projection is positioned between said another tooth and said next adjacent tooth; and wherein a plurality of first and second pairs of teeth defining a plurality of first and second gaps are provided along a lengthwise direction of the comb, and wherein at least one first gap is provided between two of said second gaps.

39. A comb according to claim 38, wherein each of the teeth defining at least one of the second gaps includes a projection extending towards the opposite tooth.

40. A comb according to claim 38, wherein at least one of the teeth defining at least one of the second gaps is hook shaped.

41. A comb according to claim 40, wherein the at least one of the teeth which is hook shaped is made at least partially of a resiliently deformable material.

42. A comb according to claim 40, wherein the at least one of the teeth defining at least one of the second gaps includes an edge extending both towards a bottom of the second gap and towards the other tooth defining this second gap.

43. A comb according to claim 42, wherein the second height is between ½ and ¾ of the first height.

44. A comb according to claim 43, wherein the second height is approximately ⅔ of the first height.

45. A comb according to claim 38, wherein the comb includes from 2 to 20 second pairs of teeth.

46. A comb according to claim 38, wherein the comb is molded as a one piece molding with at least one plastic material.

47. A comb according to claim 38, wherein one of the teeth defining each of the second gaps is made at least partially of a resiliently deformable material.

48. A comb according to claim 38, wherein the projection extends both towards a bottom of each respective second gap and towards the other tooth defining each respective second gap.

49. A comb according to claim 38, wherein a spacing between the teeth defining each second gap is smaller than that between the teeth defining each first gap.

50. A comb according to claim 38, wherein the second height of each second gap is between ¼ and ¾ of the first height of each first gap.

51. A comb according to claim 50, wherein a width of at least some of the first gaps in the lengthwise direction of the comb is larger than a width of at least some of the second gaps.

52. A comb according to claim 38, wherein the second height of each second gap is between ½ and ¾ of the first height of each first gap.

53. A comb according to claim 38, wherein one of the first gaps is adjacent to one of the second gaps, and wherein a tooth of the first pair defining said one of the first gaps is also a tooth of the second pair defining said one of the second gaps.

54. A comb according to claim 38, wherein each first gap is adjacent to at least one of the second gaps, and wherein a tooth of each first pair is also a tooth of one of the second pairs.

55. A comb according to claim 38, wherein a plurality of teeth are provided between two second pairs of teeth.

56. A comb according to claim 38, wherein a width of at least some of the first gaps in the lengthwise direction of the comb is larger than a width of at least some of the second gaps.

57. A comb according to claim 56, wherein a width of each first gap is larger than a width of each second gap.

58. A comb according to claim 38, further including a handle to grasp the comb at a location spaced from the first and second pairs of teeth in a lengthwise direction of the comb.

59. A comb according to claim 38, wherein a distance from a lengthwise axis of the comb to a bottom of each first gap is smaller than a distance from the lengthwise axis of the comb to a bottom of each second gap.

60. A comb according to claim 38, wherein a distance from one second gap to a next second gap along a lengthwise direction of the comb is larger than a width of at least one of said second gaps in said lengthwise direction.

61. A comb according to claim 38, wherein said first width is larger than said second width.

62. A comb according to claim 61, wherein a plurality of first gaps are between one of said second gaps and a next adjacent one of said second gaps.

63. A comb according to claim 62, wherein heights of said first and second pairs of teeth from said lengthwise axis are the same.

64. A comb according to claim 38, wherein said second width is larger than said first width.

65. A comb according to claim 64, wherein said first width is a width of said second gap and said second width is a width of said first gap, and wherein a plurality of said first and second gaps are alternatingly disposed along the lengthwise axis.

66. A comb according to claim 65, wherein heights of said first and second pairs of teeth from said lengthwise axis are the same.

* * * * *